US007694433B2

(12) United States Patent
Fisher et al.

(10) Patent No.: US 7,694,433 B2
(45) Date of Patent: Apr. 13, 2010

(54) WEB HANDLING APPARATUS AND PROCESS FOR PROVIDING STEAM TO A WEB MATERIAL

(75) Inventors: Wayne Robert Fisher, CIncinnati, OH (US); Mark Stephen Conroy, Cincinnati, OH (US); Donn Nathan Boatman, Union, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 556 days.

(21) Appl. No.: 11/147,697

(22) Filed: Jun. 8, 2005

(65) Prior Publication Data

US 2006/0283038 A1 Dec. 21, 2006

(51) Int. Cl.
*F26B 3/00* (2006.01)

(52) U.S. Cl. ..... 34/463; 34/446; 34/449; 34/633; 34/638

(58) Field of Classification Search ..... 34/463, 34/114, 115, 119, 122, 446, 447, 449, 633, 34/638, 640; 162/207, 252, 290, 389, 449
See application file for complete search history.

(56) References Cited

U.S. PATENT DOCUMENTS

| | | | | |
|---|---|---|---|---|
| 3,587,177 | A | 6/1971 | Overly et al. | |
| 3,868,215 | A | 2/1975 | Frezza | |
| 3,950,988 | A | 4/1976 | Nowisch et al. | |
| 3,960,303 | A | 6/1976 | Gatti et al. | |
| 4,043,495 | A | 8/1977 | Sander | |
| 4,055,003 | A | 10/1977 | Sack | |
| 4,074,841 | A | 2/1978 | Kramer et al. | |
| 4,109,520 | A | 8/1978 | Eriksson | |
| 4,191,612 | A | 3/1980 | Araoka | |
| 4,197,972 | A | 4/1980 | Daane | |
| 4,197,973 | A | 4/1980 | Daane | |
| 4,201,323 | A | 5/1980 | Stibbe et al. | |
| 4,207,143 | A | 6/1980 | Glomb et al. | |
| 4,268,976 | A * | 5/1981 | Dove | 34/636 |
| 4,288,015 | A | 9/1981 | Curtin | |
| 4,308,984 | A | 1/1982 | Vits | |
| 4,321,760 | A | 3/1982 | Meier | |
| 4,400,846 | A | 8/1983 | Sanderson | |
| 4,403,495 | A | 9/1983 | Talbot | |
| 4,425,719 | A | 1/1984 | Klein et al. | |
| 4,464,143 | A | 8/1984 | Bowyer | |
| 4,492,328 | A | 1/1985 | Münnich et al. | |
| 4,514,345 | A | 4/1985 | Johnson et al. | |
| 4,528,239 | A | 7/1985 | Trokhan | |
| 4,596,632 | A | 6/1986 | Goetz et al. | |
| 4,685,221 | A | 8/1987 | Taylor et al. | |

(Continued)

FOREIGN PATENT DOCUMENTS

| | | |
|---|---|---|
| DE | 14 11 903 A1 | 6/1969 |

(Continued)

*Primary Examiner*—Kenneth B Rinehart
(74) *Attorney, Agent, or Firm*—Peter D. Meyer; Betty J. Zea

(57) ABSTRACT

A method for processing a web material having a machine direction and a cross-machine direction coplanar and perpendicular thereto is disclosed herein. The method incorporates the step of first directing a web material proximate to an air foil. Steam is then applied to the web material by the air foil. Finally, the web material is processed by any downstream web material processing operation.

12 Claims, 3 Drawing Sheets

U.S. PATENT DOCUMENTS 4,718,178 A 1/1988 Whipple
4,765,067 A * 8/1988 Taylor ..... 34/465
4,785,986 A 11/1988 Daane et al.
4,819,928 A 4/1989 Osborn et al.
4,836,429 A 6/1989 Nakashima et al.
4,901,449 A 2/1990 Wimberger
4,913,329 A 4/1990 Cahill et al.
4,919,319 A 4/1990 Ford et al.
4,921,034 A 5/1990 Burgess et al.
5,020,245 A 6/1991 Langevin et al.
5,020,381 A 6/1991 Bartlett
5,022,166 A 6/1991 Nguyen et al.
5,052,233 A 10/1991 Rantala
5,070,628 A 12/1991 Zagar
5,090,133 A 2/1992 Taylor
5,092,059 A 3/1992 Wimberger et al.
5,098,522 A 3/1992 Smurkoski et al.
5,149,401 A 9/1992 Langevin et al.
5,203,485 A 4/1993 Cahill et al.
5,209,387 A 5/1993 Long et al.
5,235,733 A 8/1993 Willbanks et al.
5,260,171 A 11/1993 Smurkoski et al.
5,275,700 A 1/1994 Trokhan
5,317,817 A 6/1994 Roberts et al.
5,328,565 A 7/1994 Rasch et al.
5,334,289 A 8/1994 Trokhan et al.
5,370,289 A 12/1994 Helms
5,431,786 A 7/1995 Rasch et al.
5,452,834 A 9/1995 Mariotti et al.
5,480,085 A 1/1996 Smithe et al.
5,480,086 A 1/1996 Nakashima et al.
5,496,624 A 3/1996 Stelljes, Jr. et al.
5,500,277 A 3/1996 Trokhan et al.
5,514,523 A 5/1996 Trokhan et al.
5,520,317 A 5/1996 Eckert et al.
5,554,467 A 9/1996 Trokhan et al.
5,558,263 A 9/1996 Long
5,566,724 A 10/1996 Trokhan et al.
5,577,294 A 11/1996 Pollock
5,593,545 A 1/1997 Rugowski et al.
5,624,790 A 4/1997 Trokhan et al.
5,628,876 A 5/1997 Ayers et al.
5,650,214 A 7/1997 Anderson et al.
5,671,895 A 9/1997 Cederholm et al.
5,679,222 A 10/1997 Rasch et al.
5,709,352 A 1/1998 Rogers et al.
5,709,389 A 1/1998 Algers et al.
5,714,041 A 2/1998 Ayers et al.
5,730,389 A 3/1998 Baigiotti
5,738,760 A 4/1998 Svanqvist et al.
5,759,352 A 6/1998 Lau et al.
5,775,623 A 7/1998 Long
5,789,031 A 8/1998 Hirabayashi et al.
5,794,500 A 8/1998 Long et al.
5,833,106 A 11/1998 Harris
5,837,910 A 11/1998 Beijbom et al.
5,888,349 A 3/1999 Lau et al.
5,891,309 A 4/1999 Page et al.
5,906,333 A 5/1999 Fortuna et al.
5,948,210 A 9/1999 Huston
5,954,097 A 9/1999 Boutilier
5,967,457 A * 10/1999 Wildenberg et al. ..... 242/615.4
5,970,627 A 10/1999 Stenz et al.
5,972,813 A 10/1999 Polat et al.
5,979,731 A 11/1999 Long et al.
6,004,432 A 12/1999 Page et al.
6,010,598 A 1/2000 Boutilier et al.
6,030,496 A 2/2000 Baggot et al.
6,077,590 A 6/2000 Archer et al.
6,099,781 A 8/2000 Ampulski
6,110,324 A 8/2000 Trokhan et al.
6,125,754 A 10/2000 Harris
6,136,147 A 10/2000 Edwards et al.
6,325,896 B1 12/2001 Hultcrantz et al.
6,328,852 B1 12/2001 McGary et al.
6,364,247 B1 4/2002 Polkinghorne
6,374,247 B1 4/2002 Gebauer
6,375,801 B2 4/2002 McGary et al.
6,397,495 B1 6/2002 Doherty et al.
6,440,268 B1 * 8/2002 Baggot et al. ..... 162/118
6,454,903 B2 9/2002 Mohrsen et al.
6,505,792 B1 1/2003 Rocheleau et al.

FOREIGN PATENT DOCUMENTS

EP 0 380 427 A2 8/1990
FR 2 393 616 A1 1/1979
WO WO 94/16290 7/1994

* cited by examiner

WEB HANDLING APPARATUS AND PROCESS FOR PROVIDING STEAM TO A WEB MATERIAL

FIELD OF THE INVENTION

The present invention relates to an apparatus for applying a fluid to a moving web material in order to enhance the effect of various web-handling processes. By way of example, the application of steam can be used to effectively plasticize a web material making it more susceptible to deformation.

BACKGROUND OF THE INVENTION

In the manufacture and processing of a moving web material, it is desirable to provide for the introduction of fluids, such as steam, to the web material in order to enhance the effect of various web-handling processes. For example, steam can be used to moisturize a web that has been over dried due to equipment in the web making or web handling process that tend to remove moisture from the web material during handling. It is known that condensation on the web material, due to the impingement of steam thereon, effectively increases the temperature of the web material and its effective moisture content. This is believed to effectively plasticize the web and make it easier and more susceptible to deformation. In addition, steam has been used to improve both the bulk generation and tensile efficiency of such embossing procedures that impart a high definition embossment. Such steam processes have been used in the processing of air laid substrates, single ply wet laid substrates, dual ply wet laid substrates, non-woven substrates, woven fabrics, and knit fabrics.

Numerous processes for the application of steam to a web material are known in the art. For example, parent rolls of creped base sheet materials can be unwound and passed over a steam boom prior to embossing the web material between matched steel embossing rolls. In such a process,-high quality steam is supplied to an application boom at anywhere from 5 psi to 10 psi. A typical boom is constructed from stainless steel pipe, capped on one or both ends, that is provided with a plurality of nozzles. The nozzles are capable of providing a spray of steam upon a passing web material as the web material passes proximate to the steam boom. An exemplary process utilizing such an application is described in U.S. Pat. No. 6,077,590.

However, such an application can have significant drawbacks. For example, the steam is applied to the passing web material in an ambient environment. This can allow steam that does not impinge upon the web material to be released to the ambient atmosphere and then condense upon the processing equipment. Such condensation can cause the appearance of rust upon processing equipment. This can then shorten the lifespan of expensive processing equipment. In addition, the impingement of steam upon the passing web material can cause debris resident upon the web material to dislodge. This dislodged debris is then airborne and can be deposited upon the damp processing equipment. Such a collection and buildup of debris increases the risk of product contamination, or otherwise increases the frequency and effort required to clean and maintain the processing equipment. Additionally, not all steam emanating from the stainless steel pipe is effectively deposited upon the passing web material. If one were to consider a steam molecule as a particle, the steam particle, upon release from the steam boom, is provided with sufficient momentum to enable it to rebound off the web material to the ambient atmosphere surrounding the web material. This does not provide any heating effects upon the web material. This may provide insufficient heat to the web material in order to facilitate any plastic deformation that may be required due to the needs of any downstream processing. In sum, these processes are simply not efficient.

There are other systems for applying steam to a web material that have higher stated efficiencies. However, these systems tend to be unnecessarily complex. For example, some systems provide a pair of dripless steam boxes arranged above and below the plane of a passing web material. The steam boxes are generally closely embraced and enclosed by a steam chamber housing. The steam chamber housing momentarily confines a billowing steam in the immediate vicinity of the web material. Excess steam is removed by way of a downdraft exhaust system. Such steam processing systems are disclosed in U.S. Pat. No. 3,868,215. The incorporation of such complex processing equipment into a web material processing system is generally not financially feasible.

Therefore, it would be advantageous to provide for the application of a fluid, such as steam, to a passing web material in a cost effective and non-complex manner. It is in this way that a web material can be heated and moisturized in order to facilitate plastic deformation. Increasing the ability of a web material to plastically deform facilitates the downstream treatment of the treated web material for embossing, compaction, softening, and contraction.

SUMMARY OF THE INVENTION

The present invention provides a method for processing a web material having a machine direction and a cross-machine direction coplanar and perpendicular thereto. The method comprises the step of first, directing a web material proximate to an air foil. Steam is then applied to the web material by the air foil. The web material can then be processed as required by the intended use.

The present invention also provides a method for applying steam to a web material. The method comprises the steps of providing an air foil having at least one aperture disposed thereon, passing steam through the at least one aperture, and directing the web material proximate to the steam so that the steam impinges upon the web material.

The present invention also provides for a method for making an embossed web material having a machine direction and a cross-machine direction coplanar and perpendicular thereto. The method comprises the steps of making a dry web material, directing the dry web material proximate to an air foil, applying steam to the dry web material by the air foil, and embossing the web material.

DETAILED DESCRIPTION OF THE INVENTION

Figure 1:
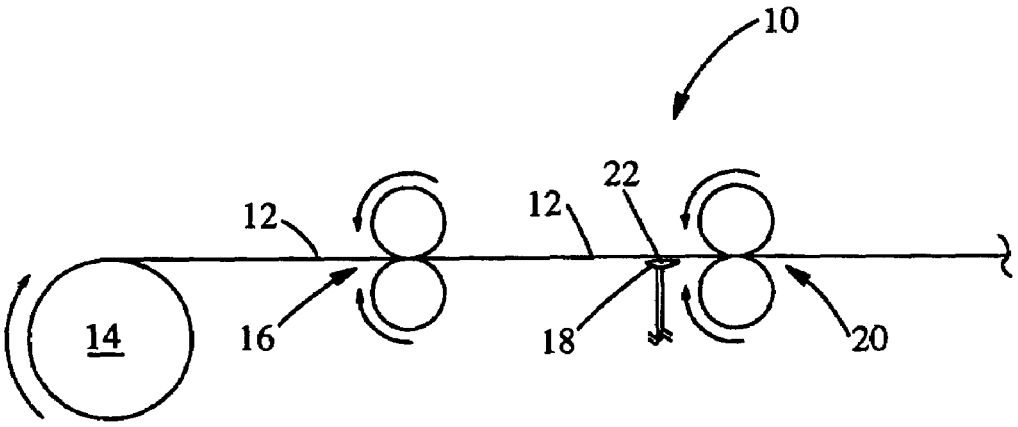
FIG. 1 is a plan view of an exemplary embodiment of a process for the incorporation of a fluid into a passing web material according to the present invention.

It has been discovered that the introduction of a fluid, such as steam, into a web material prior to any processing of the web material can enhance the effect of the downstream process. For example, it is believed that the impingement and ensuing condensation of the steam upon, and/or into, a web material prior to any downstream processing increases both the temperature and moisture content of the web material. Increasing the temperature and/or moisture of a web material can effectively render the web material more susceptible to plastic deformation, thereby making the web material easier to deform. In this regard, it has been found that air foils can be used as a delivery device for the impingement of such a fluid upon, and/or into, such a web material. Using an air foil as a delivery device for such a fluid can maintain intimate contact between the steam and the web material for a period of time sufficient to allow for the condensation of the such a fluid onto and into the web material to occur. While it is known that air foils can be effective in the separation of boundary layer air from a high speed web material surface, it was surprisingly found that the introduction of fluids in place of the boundary layer air removed from the web material by the air foil can provide the above-mentioned benefits to the web material.

It should be realized that fluids commensurate in scope with the present invention could provide virtually any desired benefit to a web material. Such a benefit can comprise the appearance, texture, smell, or any other desired, or intended, physical characteristic of the web material. In this regard, fluids commensurate in scope with the present invention can include substantially gaseous substances, such as aerosols, smoke, other particulate-containing fluids, as well as liquids that can be heated to their gaseous form, such as steam, hydrocarbons, water-laden air, other chemical vapors, and the like. While a preferred embodiment of the present invention incorporates the use of steam as a fluid, it should be understood that a reference to steam is inclusive of any fluid or combinations of fluids, and/or vapors suitable for use with the present invention as discussed supra.

Web materials having an increased susceptibility to plastic deformation can demonstrate an improved embossment appearance for any given embossment design and appropriate depth of engagement. In other words, the addition of a small amount of moisture to a web material by the application of steam can increase the amount of stretch in the web material thereby allowing for a better embossment appearance. This can be particularly true with wet laid and air laid substrates that have been embossed with a deep nested embossing process.

TABLE 1

Exemplary CD Dry Tensile Efficiencies for Non-Steam Enhanced and Steam Enhanced Wet Laid Cellulose

| Steam (On/Off) | Depth of Engagement (mils) | CD Dry Tensile Strength (g/in) | Deformation Height (microns) |
|---|---|---|---|
| Off | 95 | 692 | 781 |
| On | 95 | 709 | 1012 |
| Off | 110 | 585 | 939 |
| On | 110 | 665 | 1255 |

As can be seen from Table 1, the application of steam to a wet laid cellulose web material prior to deep nested embossing can provide the finally embossed cellulose web material with a higher deformation height having a higher cross-machine direction (CD) dry tensile efficiency than a similar cellulose web material not treated with steam. By convention and as should be known to those of skill in the art, CD dry tensile efficiencies are generally used as a measure of web strength because wet laid substrates are known to have less CD stretch than machine-direction (MD) stretch. Thus, as was found and summarized in Table 1, the application of steam to the web material prior to such an embossing step can provide additional stretch (i.e., tensile efficiency) to the web material.

Figure 4:
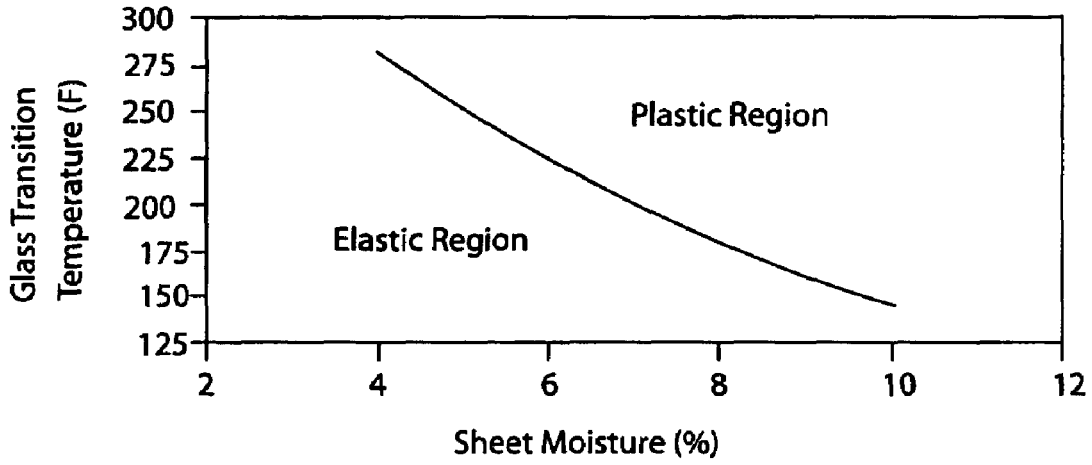
FIG. 4 is a graph of the glass transition temerature for 60% crystalline cellulose.

As can be seen from FIG. 4, without desiring to be bound by theory, it is believed that the application of steam to a cellulose web material causes an increase in both the moisture content and effective temperature of the treated web material. This causes the cellulose web material to move from the region indicated on the graph as elastic (i.e., where the fiber tends to exhibit behavior typical elastic-like behavior) to the region where the cellulose substrate is capable of plastic deformation. Such a graph is typical for many cellulose materials and can be found in references including J. Vreeland, et al., *Tappi Journal,* 1989, pp. 139-145.

FIG. 1 depicts an exemplary method for the application of steam to a web material suitable for use with an embossing process. The process 10 provides for a web material 12 to be unwound from a parent roll 14 and passed between a first nip 16. The web material 12 is then passed proximate to air foil 18 where steam 22 is discharged from air foil 18 and impinges upon, and preferably into, web material 12. In this way, steam 22 is provided with a residence time proximate to web material 12 that is equivalent to the MD dimension of air foil 18. Web materials 12 (such as air laid substrates, single ply substrates, multiple-ply substrates, wet laid substrates, non-woven substrates, woven fabrics, knit fabrics, and combinations thereof) can then be treated in any downstream operation 20 including but not limited to rubber-to-steel embossing, matched steel embossing, deep nested embossing, compaction, softening, micro-contraction, and combinations thereof.

Figure 2:
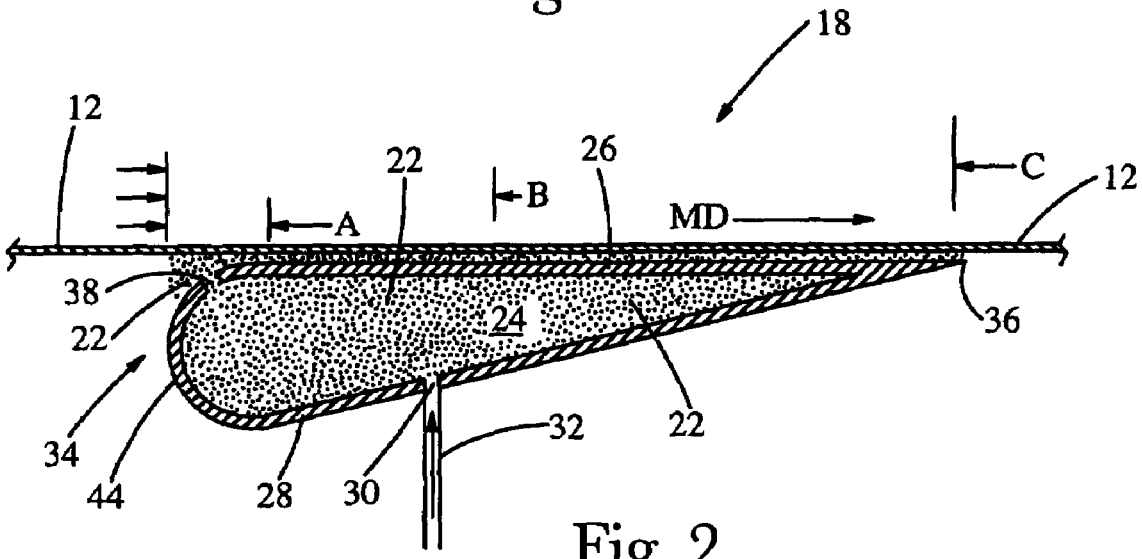
FIG. 2 is cross-sectional view of an exemplary embodiment of a device to provide for the incorporation of a fluid into a passing web material.

As can be seen from FIG. 2, air foil 18 is provided with leading edge 34 and trailing edge 36. Web material 12 approaches proximate air foil 18 and is coincident with air foil 18 along first surface 26. Steam 22 is provided along conduit 32 to air foil 18 through region 30 and is contained within internal region 24 of air foil 18. Steam 22 contained within internal region 24 of air foil 18 is then provided with sufficient pressure to enable steam 24 to exit air foil 18 through aperture 38 proximate to the leading edge 34. As web material 12 approaches proximate air foil 18, boundary layer air proximate to web foil 12 is directed aerodynamically and fluidly past leading edge 34 to the second surface 28 of air foil 18. Removal of boundary layer air from web material 12 proximate to leading edge 34 of air foil 18 then facilitates the migration and/or fluid transmission of steam 22 through region 38 to a position external to air foil 18 and in contact with web material 12. If web material 12 is provided with a machine direction tension, the migration of steam 22 into the web material 12 proximate to air foil 18 along the first surface 26 can be coincident with the movement of web material 12 past first surface 26 of air foil 18. Therefore, steam 22 should remain proximate to web material 12 for the distance that web material 12 traverses from leading edge 34 to trailing edge 36 of air foil 18. A higher speed web material 12 may require air foil 18 to have an increased MD dimension in order to provide for adequate residence time for steam 22 to remain proximate to air foil 18.

Without desiring to be bound by theory, it is believed that increasing the residence time that steam 22 is proximate to web material 12 provides for an increased impingement of steam 22 upon and into web material 12. This can then provide the benefits described supra (i.e., better embossing, better compaction, better softening, and/or better contraction).

In the exemplary embodiment shown in FIG. 2, the aperture 38 is disposed upon air foil 18 in a region proximate to leading edge 34 and is depicted as the dimension labeled A. However, one of skill in the art would understand that the aperture 38 could be positioned in the forward half of air foil 18, depicted as dimension B. However, one of skill in the art will understand that the impingement of steam 22 upon web material 12 from aperture 38 can be initiated at any point along the first surface 26 of air foil 18, herein depicted as the dimension labeled C. An appropriate air foil 18 of appropriate shape and the required dimensions for use on a full width converting line could be fabricated via well known and commercially available techniques, such as aluminum extrusion, and the like.

As known to those of skill in the art, a typical full-scale converting process, such as those incorporating the PCMC Kroleus Center Rewinder, may have a maximum web material 12 speed of about 2000 feet per minute (610 meters per minute), with a maximum web material 12 width of about 111 inches (2.82 m). For such an application, an exemplary air foil 18 can be formed from extruded aluminum. This exemplary, but non-limiting, air foil 18 could be provided with dimensions of about 4 inches (10.16 cm) in MD length, 1 inch (2.54 cm) in height, 1 inch (2.54 cm) steam 22 feed ports spaced about 12 inches (30.48 cm) apart in the CD. An air foil 18 can be provided with a single leading edge 34 slot having a width of about 0.015 inches (0.38 mm) across the width of the air foil 18 can provide adequate steam 22 flow and CD uniformity to enhance typical web material 12 processing operations such as embossing. Additionally, the inclusion of internal support members in an air foil 18 extrusion die design can provide additional structural stability to air foil 18. However, it is preferred that such internal members do not excessively restrict the cross sectional area available for CD steam 22 flow within air foil 18.

For higher speed web material 12 operations, it may be desirable to increase the MD length of the air foil 18 in order to provide sufficient residence time for steam 22 condensation to occur upon, and in, web material 12, without any theoretical limit. Reducing the MD length of the air foil 18 may provide some material cost savings and still provide adequate contact time of steam 22 upon web material 12. However, the MD length of air foil 18 should not be reduced to the point where effective CD steam 22 flow is constrained. Additionally, the height of the air foil 18 could be increased without any theoretical limit to provide additional CD area.

The exemplary, but non-limiting, shape of air foil 18 shown in FIG. 2 was found to provide effective steam 22 transfer to the web material 12 without disturbing any pre-existing web material 12 process path. As would be known to one of skill in the art, it is possible to incorporate well known air-foil design principles to provide a single air foil 18 for both the addition of steam 22 and to provide common air foil 18 functions such as web spreading, web control, web turning, and the like. In this case, a preferred air foil 18 could be designed to be symmetrical or semi-symmetrical, and the web material 12 path could wrap around a substantial portion of the curved surface of such an air foil 18. Likewise, the air foil 18 could be bowed slightly as required.

Returning again to FIG. 1, the air foil 18 is preferably placed directly in the pre-existing web material 12 path between the nips of the two processing units 16 and 20. The air foil 18 could be positioned further into the web material 12 path to improve its functionality as a web material 12 handling device. However, this may tend to increase the drag force across the web material 12. If web material 12 handling is not required, it is generally preferable to place the air foil 18 such that contact between the web material 12 and the air foil 18 is reliably maintained for the full length of the air foil (A to C) with minimal drag, as shown in FIG. 2.

The shape of air foil 18 could be modified such that the stagnation point 44 (the foremost point on the leading edge 34) of the air foil 18, is closer to the web material 12 path. The degree of asymmetry of the leading edge 34 of air foil 18 could be increased to drive more of the boundary layer air away from the steam-web interaction zone positioned between the stagnation point 44 and the web material 12. However, it is desirable to maintain a separation between the aperture 38 and the web material 12 path in order to prevent loose fibers from building up and plugging portions of the aperture 38. Additionally, it is preferable to position the trailing edge 36 of the air foil 18 as close as practicable to any downstream processing equipment 20 in order to minimize heat losses from the web material 12 prior to processing.

Although not shown, the steam system supply piping is designed to supply high quality steam to the air foil 18. Target steam pressure at the exit 38 of air foil 18 preferably ranges between from about 0.5 psi (3,450 Pa) to about 5 psi (34,500 Pa). Ideally, the supply pressure is high enough that the pressure at the point of application of steam 22 upon web material 12 can be controlled to a range that encompasses the target pressure. However, it should be realized that high quality steam could be supplied to air foil 18 in any manner known to those of skill in the art including those described in U.S. Pat. No. 6,077,590.

Figure 3:
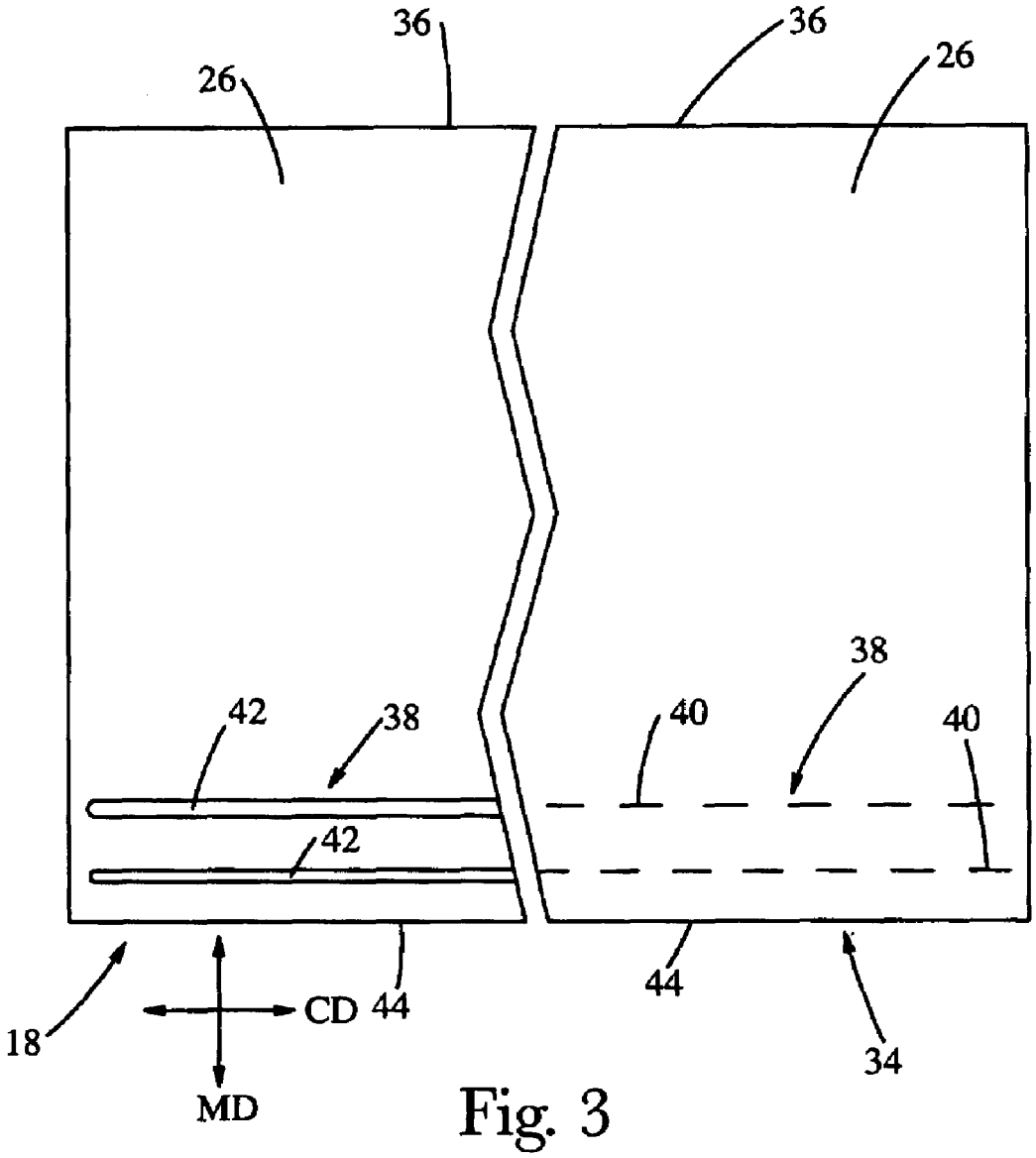
FIG. 3 is a top plan view in partial break away of the exemplary embodiment of FIG. 3 detailing various types and configurations of apertures suitable for an exemplary device according to the present invention.

As shown in FIGS. 2 and 3, aperture 38 is generally disposed within the first surface 26 of air foil 18. Aperture 38 can be provided as a hole (not shown), slot 42, and/or slit 40 disposed over at least a portion of the first surface 26 of air foil 18. Alternatively, aperture 38 can be provided as a plurality of holes (not shown), slots 42, and/or slits 40 disposed over at least a portion of the first surface 26 of air foil 18 in the MD and/or the CD. Specifically, using a series of short slits 40 spaced in the MD and staggered across air foil 18 in the CD may provide improved structural stability to air foil 18 as compared to a single hole (not shown), a single slot 42, or a single elongate slit 40. This can provide structural stability to air foil 18 as air foil 18 heats and cools during typical production cycles. In some applications, it may be preferable to use multiple holes (not shown), slots 42, or slits 40 to provide higher steam 22 flow at a reduced steam 22 pressure (vis-à-vis a single hole, slot 42, or slit 40 at higher steam 22 supply pressure) to prevent web material 12 blow-through and/or the dislodgment of loosely bound fibers comprising web material 12. Additionally, the holes, slots 42, and/or slits 40, can be continuous, discontinuous, collinear, and/or collectively elongate in the MD, CD, and/or any angle relative to the CD. The total open area of the aperture(s) 38 is preferably selected to provide a 1-3% increase in the moisture content of web material 12, and a corresponding 24° F. to 72° F. increase in the temperature of web material 12. Referring again to FIG. 4, this combination of moisture and temperature increase in web material 12 can be effective in facilitating the transition of the cellulose materials comprising web material 12 from elastic to plastic deformation capability. For typical wet laid and air laid substrates, a single CD slot between 0.015 inches (0.38 mm) and 0.060 inches (1.52 mm) wide can deliver ample flow at a range of about 0.5 psi (3,450 Pa) to about 5 psi (34,500 Pa) steam 22 pressure.

It was surprisingly found that the impingement of steam 22 upon moving web material 12 from air foil 18 along a narrow slit 40 positioned proximate to the leading edge 34 of air foil 18 provides for the longest residence time of steam 22 proximate to web material 12 as web material 12 traverses the length of air foil 18. This can also maximize the impingement of steam 22 into web material 12. In one embodiment, it was found that a narrow slit 40 provided proximate to leading edge 34 of air foil 18 would provide uniform steam 22 impingement upon web material 12 and maximizes the transference of steam 22 onto and into web material 12. Further, providing a plurality of rows comprising slits 40 staggered in the CD as discussed supra, provides for an even impingement of steam 22 upon, and ultimately into, web material 12.

EXAMPLE

One fibrous structure useful for providing an embossed paper product can be obtained by through-air-drying. Such a through-air-dried differential density structure is described in U.S. Pat. No. 4,528,239. Such a structure may be formed by the following process:

A pilot scare Fourdrinier, through air dried paper making machine is suitable to produce an appropriate paper product. A slurry of paper making fibers is pumped to the head box at a consistency of about 0.15%. The slurry preferably consists of about 65% northern softwood kraft fibers and about 35% unrefined southern softwood kraft fibers. The fiber slurry preferably contains a cationic polyamine-epichlorohydrin wet strength resin at a concentration of about 12.5 kilograms per metric ton of dry fiber and carboxymethyl cellulose at a concentration of about 3.25 kilograms per metric ton of dry fiber.

Dewatering of the fiber slurry occurs through the Fourdrinier wire and is assisted by vacuum boxes. The wire is of a configuration having 33.1 MD and 30.7 CD filaments per centimeter.

The embryonic wet web is preferably transferred from the Fourdrinier wire at a fiber consistency of about 22% at the point of transfer to a through air drying carrier fabric. The wire speed is about 195 meters per minute. The carrier fabric speed is about 183 meters per minute. Since the wire speed is about 6% faster than the carrier fabric, wet shortening of the wet web occurs at the transfer point resulting in the wet web being foreshortened about 6%. The sheet side of the carrier fabric consists of a continuous, patterned network of photopolymer resin. The pattern preferably contains about 330 deflection conduits per inch. The deflection conduits are preferably arranged in a biaxially staggered configuration and the polymer network preferably covers about 25% of the surface area of the carrier fabric. The polymer resin is supported by and attached to a woven support member consisting of 27.6 MD and 13.8 CD filaments per centimeter. The photopolymer network rises about 0.203 millimeters above the support member.

The consistency of the web is about 65% after the action of the through air drier operating at about 232° C., before transfer to a Yankee drier. An aqueous solution of creping adhesive consisting of polyvinyl alcohol is applied to the Yankee surface by spray applicators at a rate of about 2.5 kilograms per metric ton of production. The Yankee drier is operated at a speed of about 183 meters per minute. The fiber consistency is increased to an estimated 99% before creping the dried web with a doctor blade. The doctor blade has a bevel angle of about 25° and is positioned with respect to the Yankee drier to provide an impact angle of about 81°. The Yankee drier is operated at about 157° C., and the Yankee hoods are operated at about 177° C.

The dry, creped web is then passed between two calendar rolls and rolled onto a steel drum operated at 165 meters per minute so that there is preferably about 16% foreshortening of the web by crepe, 6% wet micro-contraction, and an additional 10% dry crepe. The resulting paper preferably has a basis weight of about 23 grams per square meter. The paper is then collected on a reel.

The paper collected upon the reel can then be combined into a two-ply substrate and passed proximate to at least one air foil as described supra. The air foil applies steam to the web material prior to any further processing of the web material downstream from the air foil as described herein.

Such downstream application can include passing the web material through a nip formed between two emboss cylinders that have been engraved with complimentary, nesting embossing elements. The cylinders are mounted in the apparatus with their respective longitudinal axes being generally parallel to one another. The embossing elements are preferably frustoconical in shape, with a face diameter of about 1.52 mm and a floor diameter of about 0.48 mm. The height of the embossing elements on each roll can range from between about 4.0 mm and about 4.5 mm and have a radius of curvature of about 0.76 mm. The engagement of the nested rolls is set to about 2.49 mm, and the paper described above is then preferably fed through the engaged gap at a speed of about 270 meters per minute. The resulting paper product preferably has an embossment height of greater than 1000 μm and a finished wet product wet burst strength greater than about 60% of the unembossed wet strength of the original paper product.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for making an embossed web material, the method comprising the steps of:

(a) providing a dry web material having a machine direction and a cross-machine direction coplanar and perpendicular thereto;

(b) providing an air foil having a leading edge and a trailing edge and having at least one aperture disposed thereon;

(c) passing steam through said at least one aperture disposed within the first surface of the airfoil;

(d) directing said dry web material in said machine direction proximate to said first surface of the airfoil so that the steam impinges upon said dry web material increasing the moisture content and temperature of said dry web material so that said web material is capable of plastic deformation;

(e) maintaining said steam proximate to said web material for the distance that the web material traverses from the leading edge to the trailing edge of said air foil; and (f) embossing said web material after step (e).

2. The method of claim 1 wherein step (b) further comprises the step of traversing said dry web material proximate to a first surface of said air foil.

3. The method of claim 1 wherein said steam is applied to said dry web material at a pressure ranging from about 0.5 psi (3,450 Pa) to about 5 psi (34,500 Pa).

4. The method of claim 1 wherein said at least one aperture comprises a plurality of apertures selected from the group consisting of holes, slots, slits, and combinations thereof.

5. The method of claim 4 wherein said plurality of apertures comprises slits that are collectively elongate in said cross-machine direction.

6. The method of claim 4 wherein said plurality of apertures are provided as a plurality of collectively elongate cross-machine direction rows, each of said cross-machine direction rows being spaced in said machine direction, wherein each of said apertures comprising a first of said collectively elongate cross-machine direction rows being offset in said cross-machine direction from each of said apertures comprising a second of said collectively elongate cross-machine direction rows.

7. The method of claim 4 wherein the apertures are a plurality of slots.

8. The method of claim 7 wherein said air foil has a machine direction and a cross-machine direction substantially orthogonal and coplanar with said machine direction, said plurality of slots being collinear in said cross-machine direction.

9. The method of claim 7 wherein said air foil has a machine direction and a cross-machine direction substantially orthogonal and coplanar with said machine direction, said plurality of slots being spaced in said machine direction.

10. The method of claim 1 wherein said at least one aperture is a plurality of apertures spaced upon said air foil in said machine direction.

11. The method of claim 1 wherein said air foil has a planar bottom surface and said air foil directs said dry web material adjacent to said bottom surface.

12. The method of claim 11 further comprising the step of directing the dry web material parallel to said bottom surface.

* * * * *